US008551227B2

(12) United States Patent
Horne

(10) Patent No.: US 8,551,227 B2
(45) Date of Patent: Oct. 8, 2013

(54) FILTER

(75) Inventor: Lucas Horne, Malmesbury (GB)

(73) Assignee: Dyson Technology Limited, Wiltshire (GB)

( * ) Notice: Subject to any disclaimer, the term of this patent is extended or adjusted under 35 U.S.C. 154(b) by 489 days.

(21) Appl. No.: 12/837,166

(22) Filed: Jul. 15, 2010

(65) Prior Publication Data

US 2011/0016662 A1 Jan. 27, 2011

(30) Foreign Application Priority Data

Jul. 24, 2009 (GB) ..... 0912936.2

(51) Int. Cl.
*B03C 3/155* (2006.01)

(52) U.S. Cl.
USPC ..... 96/66; 55/DIG. 1; 55/DIG. 3; 96/73; 96/96; 96/97

(58) Field of Classification Search
USPC ..... 96/66, 73, 97, 96; 55/486, 487, 55/DIG. 1, DIG. 3
See application file for complete search history.

(56) References Cited

U.S. PATENT DOCUMENTS

| | | | | |
|---|---|---|---|---|
| 2,081,772 | A | | 5/1937 | Saint-Jacques |
| 2,569,710 | A | | 10/1951 | Fitzpatrick |
| 2,711,226 | A | | 6/1955 | Davis, Jr. |
| 2,864,460 | A | * | 12/1958 | Powers ..... 96/67 |
| 3,398,082 | A | * | 8/1968 | Lochmann et al. ..... 204/665 |
| 3,526,081 | A | | 9/1970 | Kusters |
| 4,010,011 | A | | 3/1977 | Reif |
| 4,133,653 | A | | 1/1979 | Soltis |
| 4,309,199 | A | | 1/1982 | Suzuki |
| 4,352,681 | A | | 10/1982 | Dietz |
| 4,370,155 | A | | 1/1983 | Armbruster |
| 4,478,613 | A | | 10/1984 | Brettschneider et al. |
| 4,507,131 | A | | 3/1985 | Fathauer et al. |
| 4,541,847 | A | | 9/1985 | Oie et al. |
| 4,718,923 | A | | 1/1988 | Haag et al. |
| 4,726,825 | A | | 2/1988 | Natale |
| 4,826,515 | A | | 5/1989 | Dyson |
| 4,853,011 | A | | 8/1989 | Dyson |
| 4,973,341 | A | | 11/1990 | Richerson |

(Continued)

FOREIGN PATENT DOCUMENTS

| | | |
|---|---|---|
| CA | 714367 | 7/1965 |
| CN | 2548689 | 5/2003 |

(Continued)

OTHER PUBLICATIONS

International Search Report and Written Opinion mailed Oct. 14, 2010, directed to counterpart International Application No. PCT/GB2010/051184; 10 pages.

(Continued)

*Primary Examiner* — Richard L Chiesa
(74) *Attorney, Agent, or Firm* — Morrison & Foerster LLP

(57) ABSTRACT

The present invention relates to an electrostatic filter. Particularly but not exclusively the invention relates to an electrostatic filter for removing dust particles, for example an electrostatic filter for use in a vacuum cleaner, fan or air conditioner. The electrostatic filter includes a filter medium located between a first and a second electrode, each at a different voltage during use, such that a potential difference is formed across the filter medium, wherein a property of the filter medium varies along the length of the filter medium.

14 Claims, 12 Drawing Sheets

(56) References Cited

U.S. PATENT DOCUMENTS

| | | | | |
|---|---|---|---|---|
| 5,143,524 | A | 9/1992 | Inculet et al. | |
| 5,230,722 | A | 7/1993 | Yonkers | |
| 5,248,323 | A | 9/1993 | Stevenson | |
| 5,405,434 | A * | 4/1995 | Inculet | 96/54 |
| 5,474,599 | A * | 12/1995 | Cheney et al. | 96/55 |
| 5,582,632 | A | 12/1996 | Nohr et al. | |
| 5,593,476 | A | 1/1997 | Coppom | |
| 5,647,890 | A | 7/1997 | Yamamoto | |
| 5,651,811 | A | 7/1997 | Frey et al. | |
| 5,683,494 | A | 11/1997 | Altman et al. | |
| 5,755,333 | A | 5/1998 | Stencel et al. | |
| 5,855,653 | A * | 1/1999 | Yamamoto | 96/58 |
| 6,003,196 | A | 12/1999 | Wright et al. | |
| 6,197,096 | B1 | 3/2001 | Cartellone | |
| 6,228,148 | B1 | 5/2001 | Aaltonen et al. | |
| 6,245,126 | B1 | 6/2001 | Feldman et al. | |
| 6,482,252 | B1 | 11/2002 | Conrad et al. | |
| 6,572,685 | B2 * | 6/2003 | Dunshee | 96/59 |
| 6,709,495 | B1 | 3/2004 | Storer | |
| 6,740,144 | B2 | 5/2004 | Conrad et al. | |
| RE39,473 | E | 1/2007 | Salo et al. | |
| 7,156,902 | B1 | 1/2007 | Altman | |
| 7,179,314 | B2 | 2/2007 | Conrad et al. | |
| 7,311,747 | B2 | 12/2007 | Adamek et al. | |
| 7,497,899 | B2 | 3/2009 | Han et al. | |
| 7,507,269 | B2 | 3/2009 | Murphy et al. | |
| 7,547,336 | B2 | 6/2009 | Fester et al. | |
| 7,556,662 | B2 | 7/2009 | Lee et al. | |
| 7,708,813 | B2 * | 5/2010 | Wiser et al. | 96/17 |
| 7,731,769 | B2 | 6/2010 | Min | |
| 7,815,720 | B2 * | 10/2010 | McKinney | 96/63 |
| 8,182,563 | B2 * | 5/2012 | Horne et al. | 55/337 |
| 2002/0134238 | A1 | 9/2002 | Conrad et al. | |
| 2003/0037676 | A1 | 2/2003 | Dunshee | |
| 2004/0065202 | A1 | 4/2004 | Gatchell et al. | |
| 2004/0177471 | A1 | 9/2004 | Jung et al. | |
| 2004/0194250 | A1 | 10/2004 | Conrad et al. | |
| 2005/0000361 | A1 | 1/2005 | Chang et al. | |
| 2005/0028675 | A1 | 2/2005 | Conrad et al. | |
| 2005/0050678 | A1 | 3/2005 | Oh et al. | |
| 2005/0087080 | A1 | 4/2005 | Yoshida et al. | |
| 2005/0091786 | A1 | 5/2005 | Wright et al. | |
| 2005/0125939 | A1 | 6/2005 | Hansen et al. | |
| 2005/0125940 | A1 | 6/2005 | McDowell | |
| 2005/0132529 | A1 | 6/2005 | Davidshofer | |
| 2005/0132886 | A1 * | 6/2005 | Schultze et al. | 96/66 |
| 2005/0177974 | A1 | 8/2005 | Conrad et al. | |
| 2006/0117520 | A1 | 6/2006 | Choi | |
| 2006/0123590 | A1 | 6/2006 | Fester et al. | |
| 2006/0151382 | A1 | 7/2006 | Petrik | |
| 2006/0168923 | A1 | 8/2006 | Lee et al. | |
| 2006/0278081 | A1 | 12/2006 | Han et al. | |
| 2007/0079587 | A1 | 4/2007 | Kim | |
| 2007/0199449 | A1 | 8/2007 | Wiser et al. | |
| 2007/0199451 | A1 | 8/2007 | Wiser | |
| 2008/0250926 | A1 | 10/2008 | Riskin | |
| 2010/0212104 | A1 | 8/2010 | Conrad | |
| 2010/0236012 | A1 | 9/2010 | Horne | |
| 2010/0242214 | A1 | 9/2010 | Sunderland et al. | |
| 2010/0242215 | A1 | 9/2010 | Dyson et al. | |
| 2010/0242216 | A1 | 9/2010 | MacNaughton | |
| 2010/0242217 | A1 | 9/2010 | Sunderland et al. | |
| 2010/0242218 | A1 | 9/2010 | Genn et al. | |
| 2010/0242219 | A1 | 9/2010 | Dyson et al. | |
| 2010/0242220 | A1 | 9/2010 | Dyson et al. | |
| 2010/0242221 | A1 | 9/2010 | Horne et al. | |
| 2011/0016659 | A1 | 1/2011 | Dyson et al. | |
| 2011/0016660 | A1 | 1/2011 | Horne | |
| 2011/0016661 | A1 | 1/2011 | Dyson et al. | |
| 2011/0016663 | A1 | 1/2011 | Horne | |

FOREIGN PATENT DOCUMENTS

| | | |
|---|---|---|
| CN | 1751648 | 3/2006 |
| CN | 1879542 | 12/2006 |
| CN | 201179381 | 1/2009 |
| DE | 38 04 651 | 8/1989 |
| EP | 0 042 723 | 12/1981 |
| EP | 0 299 197 | 1/1989 |
| EP | 0 443 254 | 8/1991 |
| EP | 0 815 788 | 2/1999 |
| EP | 1 239 760 | 9/2002 |
| EP | 1 688 078 | 8/2006 |
| EP | 1 733 795 | 12/2006 |
| FR | 2 859 372 | 3/2005 |
| FR | 2 884 857 | 10/2006 |
| GB | 2 033 256 | 5/1980 |
| GB | 2 349 105 | 10/2000 |
| GB | 2 365 324 | 2/2002 |
| GB | 2 384 451 | 7/2003 |
| GB | 2 418 163 | 3/2006 |
| GB | 2 435 626 | 9/2007 |
| JP | 43-10791 | 5/1968 |
| JP | 55-101758 | 8/1980 |
| JP | 56-53771 | 5/1981 |
| JP | 61-29856 | 2/1986 |
| JP | 7-39479 | 2/1995 |
| JP | 2000-515810 | 11/2000 |
| JP | 2003-517862 | 6/2003 |
| JP | 2004-510452 | 4/2004 |
| JP | 2005-21469 | 1/2005 |
| JP | 2005-307831 | 11/2005 |
| JP | 2006-136766 | 6/2006 |
| JP | 2006-205162 | 8/2006 |
| JP | 2006-346429 | 12/2006 |
| JP | 2007-167632 | 7/2007 |
| JP | 2007-252577 | 10/2007 |
| JP | 2007-296305 | 11/2007 |
| JP | 2008-272474 | 11/2008 |
| JP | 2009-11869 | 1/2009 |
| WO | WO-02/069777 | 9/2002 |
| WO | WO-02/069778 | 9/2002 |
| WO | WO-02/078506 | 10/2002 |
| WO | WO-2008/135708 | 11/2008 |

OTHER PUBLICATIONS

Horne, U.S. Office Action mailed Mar. 22, 2012, directed to U.S. Appl. No. 12/303,921; 8 pages.

GB Search Report dated Nov. 30, 2009, directed to counterpart GB Application No. 0912936.2; 2 pages.

Horne, L. et al., U.S. Office Action mailed Aug. 2, 2011, directed to U.S. Appl. No. 12/749,137; 9 pages.

Dyson et al., U.S. Office Action mailed Aug. 21, 2012, directed to U.S. Appl. No. 12/836,361; 7 pages.

Horne, U.S. Office Action mailed Aug. 30, 2012, directed to U.S. Appl. No. 12/836,334; 13 pages.

Horne L., U.S. Office Action mailed Dec. 19, 2012, directed to U.S. Appl. No. 12/837,262; 7 pages.

Horne L., U.S. Office Action mailed Jan. 7, 2013, directed to U.S. Appl. No. 12/836,334; 11 pages.

* cited by examiner

FILTER

REFERENCE TO RELATED APPLICATION

This application claims the priority of United Kingdom Application No. 0912936.2, filed Jul. 24, 2009, the entire contents of which are incorporated herein by reference.

FIELD OF THE INVENTION

The present invention relates to an electrostatic filter. Particularly, but not exclusively the invention relates to an electrostatic filter for removing dust particles from an airstream, for example an electrostatic filter for use in a vacuum cleaner, fan or air conditioner.

BACKGROUND OF THE INVENTION

It is well known to separate particles, such as dirt and dust particles from a fluid flow using mechanical filters, such as foam filters, cyclonic separators and electrostatic separators where dust particles are charged and then attracted to another oppositely charged surface for collection.

Known cyclonic separating apparatus include those used in vacuum cleaners. Such cyclonic separating apparatus are known to comprise a low efficiency cyclone for separating relatively large particles and a high efficiency cyclone located downstream of the low efficiency cyclone for separating the fine particles which remain entrained within the airflow (see, for example, EP 0 042 723B).

Known electrostatic filters include frictional electrostatic filters and electret medium filters. Examples of such filters are described in EP0815788, U.S. Pat. No. 7,179,314 and U.S. Pat. No. 6,482,252.

Such electrostatic filters are relatively cheap to produce but suffer from the disadvantage that their charge dissipates over time resulting in a reduction of their electrostatic properties. This in turn reduces the amount of dust the electrostatic filter can collect which may shorten the life of both the electrostatic filter itself and any further downstream filters.

Known electrostatic filters also include filters where dust particles in an airstream are charged in some way and then passed over or around a charged collector electrode for collection. An example of such a filter is described in JP2007296305 where dust particles in an airstream are charged as they pass a "corona discharge" wire and are then trapped on a conductive filter medium located downstream of the corona discharge wire. A disadvantage with this arrangement is that they are relatively inefficient, are made from relatively expensive materials and the collector electrodes require constant maintenance in order to keep them free of collected dust. Once the collector electrodes are coated in a layer of dust they are much less efficient.

Another example is shown in GB2418163 where the dust particles in an airstream are charged as they pass a corona discharge wire located inside a cyclone. The charged dust particles are then trapped on the walls of the cyclone which are coated in a conductive paint. While this arrangement is compact it suffers from the disadvantage that dust collects on the inside of the cyclones. Not only does this require constant and difficult maintenance removing dust from the walls of the cyclone, but also any dust trapped inside the cyclone will interfere with the cyclonic airflow decreasing the separation efficiency of the cyclone itself.

Another example is shown in U.S. Pat. No. 5,593,476 where a filter medium is placed between two permeable electrodes and the airflow is arranged to pass through the electrodes and through the filter media.

It is desirable for the efficiency of an electrostatic filter to be as high as possible (i.e. to separate as high a proportion as possible of very fine dust particles from the airstream), while maintaining a reasonable working life. It is also desirable that the electrostatic filter does not cause too much of a pressure drop across it.

An electrostatic filter which could provide high efficiency along with a long working life would therefore be desirable. In certain applications, for example in domestic vacuum cleaner applications, it is desirable for the appliance to be made as compact as possible without compromising the performance of the appliance. An electrostatic filter which was simpler in construction allowing easy packaging into an appliance would therefore also be desirable.

SUMMARY OF THE INVENTION

The invention therefore provides an electrostatic filter comprising a filter medium located between a first and a second electrode, each at a different voltage during use, such that a potential difference is formed across the filter medium, wherein a property of the filter medium varies along the length of the filter medium.

The property which varies may be the average pore size/diameter, the pores per inch, the electrical resistivity and/or the type of filter medium. As used herein the terms "pore size" and "pore diameter" are interchangeable. A method for measuring the average pore size/diameter and calculating the pores per inch is given in the specific description.

For example the average pore size or the number of pores per inch may decrease or increase in a downstream direction. Such a change in average pore size or number of pores per inch may be a gradual change which occurs in a single filter or a plurality of sections of filter medium may be brought together to form a filter medium which has a varying average pore size or number of pores per inch across it's length. For example, two, three, four or more sections of filter media may be used in the electrostatic filter. Again the average pore size or number of pores per inch may decrease or increase in a downstream direction, or alternatively it may vary in another random or non-random way.

Most preferably, the average pore size/diameter of the filter medium decreases in a downstream direction. Preferably the pores per inch may increase in a downstream direction.

Such an arrangement may be advantageous because, during use, the upstream end of the filter medium will be exposed to the most dust and a larger pore size will be better able to accommodate this dust without restricting airflow through the filter medium. Further downstream, smaller pore sizes will trap any smaller dust particles which have passed through the upstream portion of the filter. This arrangement may advantageously help to lower the pressure loss across the electrostatic filter.

The filter medium may be comprised of any suitable material for example glass, polyester, polypropylene, polyurethane or any other suitable plastics material. In a preferred embodiment the filter medium may comprise an open cell reticulated foam, for example a polyurethane foam. Reticulated foams are formed when the cell windows within the foam are removed to create a completely open cell network. This type of filter medium is particularly advantageous as the foam may hold its structure in an airflow. The polyurethane foam may be derived from either polyester or polyether.

The filter medium or a section of it may have 3, or 5, or 6, or, 8 or, 10, or 15, or 20, or 25, or 30 to 35, or 40, or 45, or 50, or 55, or 60 pores per inch (PPI) with an average pore diameter of from 0.4, or 0.5, or 1, or 1.5, or 2, or 2.5, or 3, or 3.5 to 4, or 4.5, or 5, or 5.5, or 6, or 6.5, or 7, or 7.5, or 8, 8.5 mm (or 400 microns to 8500 microns). In a preferred embodiment the filter medium or a section of it may have from 8 to 30 PPI with an average pore diameter of from 1.5 mm to 5 mm. In another preferred embodiment the filter medium or a section of it may have from 3 to 30 PPI with an average pore diameter of from 1.5 mm to 8 mm. Most preferably the PPI may be from 3 to 10 PPI. In a preferred embodiment an upstream portion/section of the filter medium may have a PPI of 3 PPI and a downstream portion/section may have a PPI of 6 PPI. In a preferred embodiment an upstream portion/section of the filter medium may have an average pore diameter of 7200 microns (7.2 mm) and a downstream portion/section may have an average pore diameter of 4500 microns (4.5 mm).

Preferably the first and second electrodes are substantially non-porous. Preferably the filter medium has a length and the first and second electrodes are non-porous along the length of the filter medium. In a most preferred embodiment the first and second electrodes are non-porous along their entire length.

As used herein the term "non-porous" shall be taken to mean that the first and second electrodes have continuous solid surfaces without perforations, apertures or gaps. In a preferred embodiment the first and second electrodes are non-porous such that during use an airflow travels along the length of the electrodes through the filter medium. Ideally the airflow does not pass through the first or second electrodes.

Such an arrangement where the air does not have to flow through the electrodes during use may be advantageous because it may reduce the pressure drop across the electrostatic filter. In addition because the electrodes are non-porous they have a larger surface area than they would if the electrodes were porous. This may improve the overall performance of the electrostatic filter.

In a preferred embodiment the filter medium may be an electrically resistive filter medium. As used herein the term "electrically resistive filter medium" shall be taken to mean that the filter medium has a resistivity of from $1\times10^{7}$ to $1\times10^{13}$ ohm-meters at 22° C. In a most preferred embodiment the filter medium may have a resistivity of from $2\times10^{9}$ to $2\times10^{11}$ ohm-meters at 22° C. The electrical resistivity of the filter medium may vary along the length of the filter medium. In a particular embodiment the electrical resistivity may decrease in a downstream direction.

This electrostatic filter uses the potential difference formed across the filter medium to collect dust in the filter medium itself rather than on collector electrodes. This arrangement is advantageous over previous electrostatic filters because there are no collector electrodes to clean. This may reduce the need for maintenance and increase the life of the filter due to the dust retention capacity of the filter medium.

The potential difference occurs because the electrically resistive filter medium provides a load and therefore only a small current flows through it. However the electric field will disturb the distribution of any positive and negative charges, in the fibers of the electrically resistive filter medium, causing them to align with their respective electrode. This process causes the dust to bond to or settle on the fibers of the filter medium because dust particles in an airstream passing through the filter will be attracted to respective positive and negative ends of the filter medium. This may help to cause the dust particles to be trapped in the filter medium itself without requiring the dust particles to be captured on a charged electrode.

In addition because the electrostatic filter is essentially one component i.e. the filter medium is located between the first and the second electrodes, it may be more compact than previous arrangements and may therefore be packaged more easily. It may also be possible to locate the electrostatic filter in any airstream of an appliance. This may help to allow the filter to be utilised in a domestic vacuum cleaner.

In an embodiment the filter medium may be in contact with the first and/or the second electrode. In a preferred embodiment the filter medium may be in contact with the first and/or the second electrode along its entire length, for example such that the filter medium is sandwiched between the first and second electrodes. Preferably there are no gaps between the filter medium and the first and second electrodes.

In a particularly preferred embodiment the first and second electrodes form at least a portion of the walls of an air pathway and the filter medium is in contact with the walls along its full length such that during use an airstream containing dust particles must pass through the filter medium along the air pathway.

The electrostatic filter may also further comprise at least one corona discharge means, the filter medium being arranged downstream of the corona discharge means. Adding a corona discharge means advantageously may increase the efficiency of the electrostatic filter. This is because the corona discharge means helps to charge any dust particles in the airstream before they pass through the filter medium thus helping to increase dust particle attraction to the filter medium.

In a preferred embodiment the corona discharge means may comprise at least one corona discharge electrode of high curvature and at least one electrode of low curvature. This arrangement may be advantageous as it may generate a large source of ions for charging any dust particles in the airstream. These charged dust particles are then more likely to be filtered out by the filter medium which has the potential difference across it during use.

The corona discharge electrode may be in any suitable form as long as it is of a higher curvature than the electrode of low curvature. In other words the corona discharge electrode is preferably of a shape which causes the electric filed at its surface to be greater than the electric field at the surface of the electrode of low curvature. Examples of suitable arrangements would be where the corona discharge electrode is one or more wires, points, needles or serrations and the electrode of low curvature is a tube which surrounds them. Alternatively the electrode of low curvature may be a flat plate.

In a particular embodiment the corona discharge electrode may be formed from a portion of the first or second electrode. In a preferred embodiment the corona discharge electrode is in the form of one or more points formed from or on a downstream edge of the first or second electrode. The downstream edge may be either a lower or upper edge of the first or second electrode depending on the orientation of the electrostatic filter and the direction from which air enters the electrostatic filter during use. Ideally the lower or upper edge of the second electrode is serrated to form the corona discharge electrode.

The electrode of low curvature may also be formed from a portion of the first or second electrode. In a particular embodiment the electrode of low curvature is formed from or on a downstream portion of the first or second electrode. Again the downstream portion may be either a lower or upper portion of the first or second electrode depending on the orientation of the electrostatic filter and the direction from which air enters the electrostatic filter during use.

In a preferred embodiment the lower edge of the second electrode is serrated to form the corona discharge electrode and a lower portion of the first electrode forms the electrode of low curvature. In an alternative embodiment the upper edge of the second electrode is serrated to form the corona discharge electrode and an upper portion of the first electrode forms the electrode of low curvature.

These arrangements are advantageous as there is no requirement for separate components forming the corona discharge electrode or the electrode of low curvature.

Preferably the corona discharge electrode, and/or the electrode of low curvature may project upstream from an upstream surface of the filter medium. Ideally the discharge electrode and/or the electrode of low curvature may project below a lower surface or above an upper surface of the filter medium. In a particular embodiment the electrode of low curvature projects both upstream and downstream from a lower surface of the corona discharge electrode. This is advantageous because it helps to maximize the volume over which the ionizing field is generated to maximize the opportunity for charging dust particles as they pass through the ionizing field.

In a particular embodiment the first electrode may have a higher voltage than the second electrode. Alternatively the second electrode may have a higher voltage than the first electrode. Ideally the first electrode is at 0 Volts or +/−2 kV. The second electrode may have either a higher or a lower voltage than the first electrode. In a preferred embodiment the first electrode has a higher voltage than the second electrode. In a particularly preferred embodiment the first electrode is at 0 Volts or +/−2 kV and the second electrode may be at from +/−2, or 4, or 5, or 6, or 7, or 8, or 9 to 10, or 11, or 12, or 13, or 15 or 15 kV. In a most preferred embodiment the second electrode may be at from −2 or −4 to −10 kV.

In an alternative embodiment the corona discharge electrode may be remote from the first and second electrodes. In such an embodiment the corona discharge electrode may be in the form of one or more wires, needles, points or serrations. In such an embodiment the electrode of low curvature may still be formed from a portion of the first or second electrode. In a particular embodiment a portion of the second electrode may form the electrode of low curvature.

In another alternative embodiment the corona discharge means i.e. both the corona discharge electrode and the electrode of low curvature may be located remotely from the first and second electrodes.

The first and second electrodes may be of any suitable shape, for example they may be planar and the filter medium may be sandwiched between the layers. The planer electrodes may be of any suitable shape for example square, rectangular, circular or triangular. The electrodes may be of different sizes.

Alternatively the first and/or the second electrodes may be tubular, for example they may be circular, square, triangular or any other suitable shape in cross section. In a particular embodiment the electrodes may be cylindrical with the filter medium located between the electrode cylinders. In a preferred embodiment the first and second electrodes may be located concentrically with the filter medium located concentrically between them.

The electrostatic filter may also further comprise one or more further electrodes. The one or more further electrodes may also be of any suitable shape for example planar or cylindrical. The one or more further electrodes are preferably non-porous.

In an embodiment where the first and second electrodes are cylindrical the electrostatic filter may for example further comprise a third electrode. In such an embodiment the second electrode may be located between the first and the third electrodes. In such an embodiment the second electrode may be located concentrically between the first electrode and the third electrode. In such an embodiment a further filter medium may be located between the second electrode and the third electrode. Again the second electrode and the third electrode are preferably each at a different voltage during use such that a potential difference is formed across the further filter medium.

In a particular embodiment the first electrode and the third electrode may be at the same voltage during use. The second electrode may be either positively or negatively charged. Ideally the second electrode is negatively charged. The first electrode and the third electrode may have either a higher or a lower voltage than the second electrode. In a preferred embodiment the first electrode and the third electrode may have a higher voltage than the second electrode. In a particularly preferred embodiment the first electrode and the third electrode may be at 0 Volts or +/−2 kV and the second electrode may be at +/−2, or 4 or 10 kV. In a most preferred embodiment the second electrode may be at −10 kV.

In an embodiment the electrostatic filter may comprise a plurality of cylindrical electrodes which are arranged concentrically with respect to each other, wherein a filter medium is positioned between adjacent electrodes and wherein adjacent electrodes are at different voltages during use such that a potential difference is formed across each of the filter media.

In an alternative embodiment the electrostatic filter may comprise a plurality of planar electrodes which are arranged parallel, or substantially parallel to each other, wherein a filter medium is positioned between adjacent electrodes and wherein adjacent electrodes are at different voltages during use such that a potential difference is formed across each of the filter media.

The electrodes may be formed from any suitable conductive material. Preferably, the second electrode is formed from a conductive metal sheet of from 0.1 mm, or 0.25 mm, or 0.5 mm, or 1 mm, or 1.5 mm, or 2 mm to 2.5 mm, or 3 mm, or 4 mm. Ideally the first and/or second and/or third electrode is formed from a conductive metal foil of from 0.1 mm, or 0.25 mm, or 0.5 mm, or 1 mm, or 1.5 mm, or 2 mm to 2.5 mm, or 3 mm, or 4 mm Additionally or alternatively the filter medium may be coated with one or more of the electrodes. For example one or more surfaces of the filter medium may be coated with an electrically conductive layer.

A second aspect of the present invention provides a vacuum cleaner comprising an electrostatic filter as described above. In a particular embodiment the vacuum cleaner may comprise an air pathway and a conductive metal foil may coat at least a portion of the air pathway to form the electrodes. In a particular embodiment the air pathway is a non-cyclonic air pathway.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
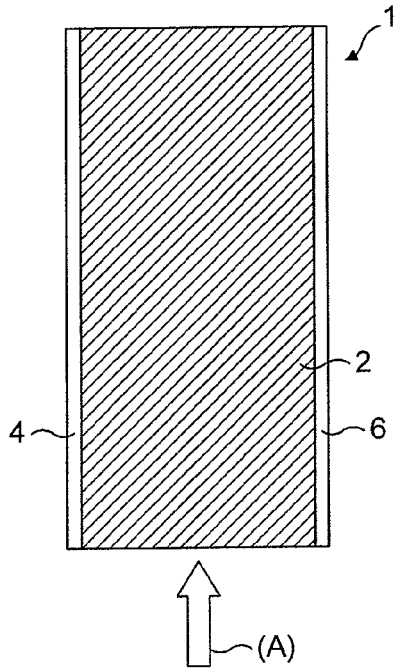
FIG. 1 is a schematic diagram showing a section through an electrostatic filter according to the present invention.

With reference to FIG. 1 an electrostatic filter is shown and indicated generally by the reference numeral 1.

It can be seen that the electrostatic filter 1 comprises an electrically resistive filter medium 2 sandwiched between and in contact with a first non-porous electrode 4 and a second non-porous electrode 6. In use the first and second electrodes 4, 6 are each at a different voltage such that a potential difference is formed across the electrically resistive filter medium 2. The first electrode 4 is at 0 Volts and the second electrode 6 is at +/−4 to 10 kV during use. The electrodes 4, 6 are connected to a high voltage power supply (not shown).

The first and second electrodes 4, 6 form at least part of an air pathway which is filled by the electrically resistive filter medium 2 such that in use dust laden air (A) must pass through the electrically resistive filter medium 2 along the length of the first and second electrodes 4,6. The potential difference generated across the electrically resistive filter medium 2 causes any charged dust particles passing through the electrostatic filter 1 to be attracted to respective positive and negative ends of the electrically resistive filter medium 2, thus causing the dust particles to be trapped. Dust particles in the dust laden air (A) may be charged before they enter the electrostatic filter 1 by friction as they pass through air passages upstream of the electrostatic filter 1.

Figure 2A:
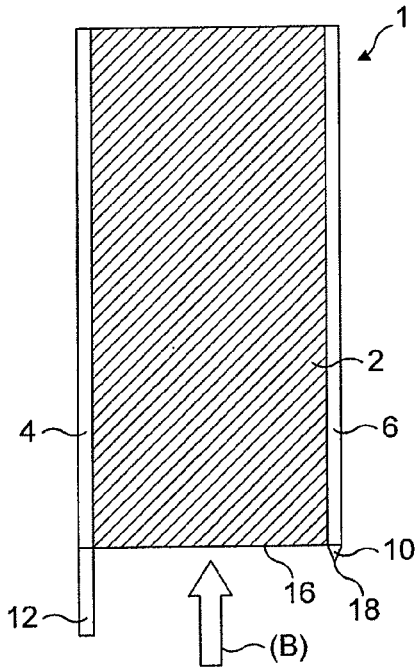
FIG. 2*a* is a schematic diagram of a section through an electrostatic filter according to the present invention.
Figure 2B:
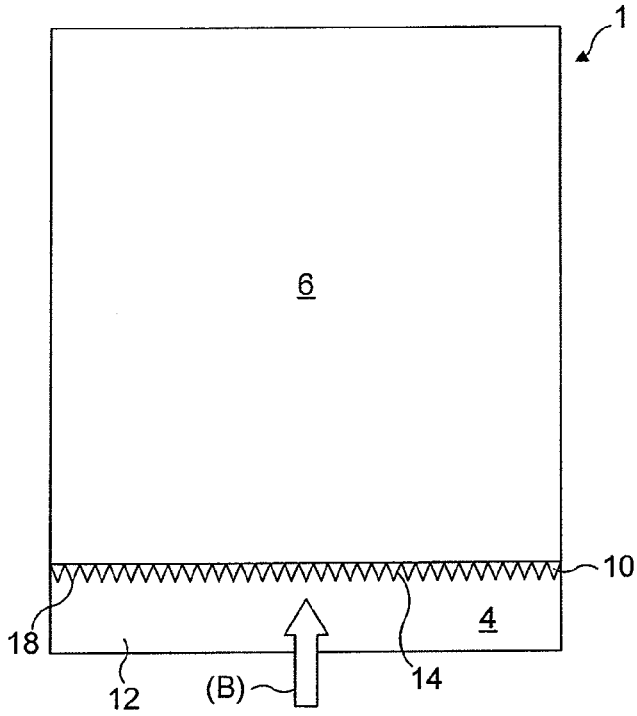
FIG. 2*b* is a side view of the electrostatic filter shown in FIG. 2*a;*

A second embodiment of the electrostatic filter 1 is shown in FIGS. 2*a* and 2*b*. In this embodiment the electrostatic filter 1 further comprises a corona discharge means. The corona discharge means comprises a corona discharge electrode of high curvature 10 and an electrode of low curvature 12. The electrode of low curvature 12 may be a flat surface or a curved surface. In this embodiment the corona discharge electrode 10 is in the form of a serrated lower edge 14 of the second electrode 6 which extends below a lower surface 16 of the electrically resistive filter medium 2 and the electrode of low curvature 12 is an extension of the first electrode 4 which projects below a lower surface 16 of the electrically resistive filter medium 2.

It is preferable that the electrode of low curvature 12 projects both upstream and downstream of the corona discharge electrode 10. This advantageously maximizes the volume over which the ionizing field is generated.

In this embodiment the first and second electrodes 4, 6 together with the corona discharge electrode 10 and the electrode of low curvature 12 form at least part of an air pathway which is partially filled by the electrically resistive filter medium 2 such that in use dust laden air (B) must pass the corona discharge means causing dust particles in the dust laden air (B) to become charged. The dust laden air (B) containing charged dust particles must then pass through the electrically resistive filter medium 2. The potential difference generated across the electrically resistive filter medium 2 causes the charged dust particles to be attracted to respective positive and negative ends of the electrically resistive filter medium 2, thus trapping them within the electrically resistive filter medium 2. In this embodiment the first electrode 4 is at 0 Volts and the second electrode 6 is at −4 to 10 kV during use. This also means that the corona discharge electrode 10 is at −4 to 10 kV and the electrode of low curvature 12 is at 0 Volts. Again the electrodes 4, 6 are connected to a high voltage power supply (not shown).

Figure 3:
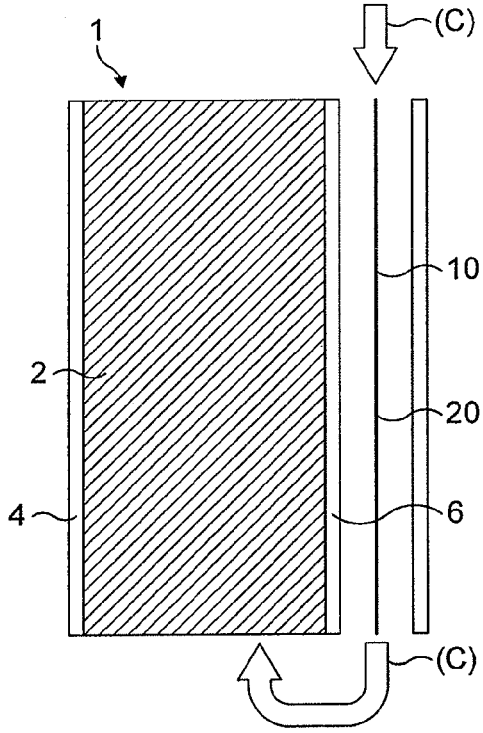
FIG. 3 is a schematic diagram of a section though an electrostatic filter according to the present invention.

In an alternative embodiment as shown in FIG. 3 the corona discharge electrode 10 may be remote from the first and second electrodes 4, 6. In such an embodiment the corona discharge electrode 10 of the corona discharge means may be in the form of one or more wires, needles, points or serrations. In the embodiment shown in FIG. 3 the corona discharge electrode 10 is in the form of a wire 20 and the electrode of low curvature 12 is the second electrode 6. In this embodiment the corona discharge electrode 10 and the second electrode 6 are preferably at different voltages. For example the corona discharge electrode may be at −4 to 10 kV and the second electrode 4 which forms the electrode of low curvature 12 may be at 0 Volts. In this embodiment the first electrode 4 may also be at a lower or higher voltage than the second electrode 6, for example the first electrode 4 may be at + or −4 to 10 kV.

In this embodiment an air passage is formed at least partially by the second electrode 6. Dust laden air (C) travels through this air passage and the dust particles are charged by the corona discharge means. The dust laden air (C) containing charged dust particles then passes into the air pathway through the electrically resistive filter medium 2 located between the first electrode 4 and the second electrode 6. Again the potential difference generated across the electrically resistive filter medium 2 causes the charged dust particles to be attracted to respective positive and negative ends of the electrically resistive filter medium 2, thus trapping them inside the electrically resistive filter medium 2.

Figure 4:
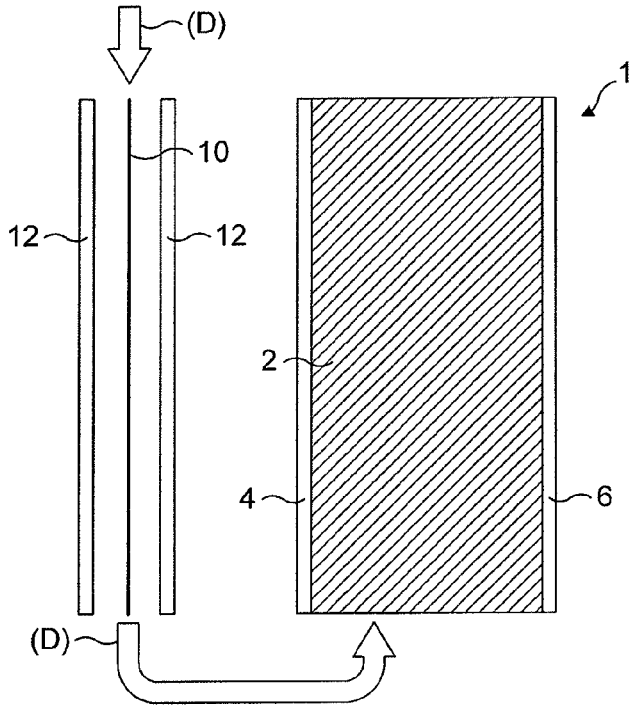
FIG. 4 is a schematic diagram of a section though an electrostatic filter according to the present invention.

In another alternative embodiment the entire corona discharge means i.e. both the corona discharge electrode 10 and the electrode of low curvature 12 may be located remotely from the first and second electrodes 4, 6. Such an embodiment can be seen in FIG. 4.

This embodiment comprises at least one corona discharge electrode 10 and at least one electrode of low curvature 12 arranged upstream of the first and second electrodes 4, 6. Dust laden air (D) travels through an air passage containing the at least on corona discharge electrode 10 and at least one electrode of low curvature 12 and the dust particles are charged by the corona discharge means. The dust laden air (D) containing the charged dust particles then passes into the air pathway through the electrically resistive filter medium 2 which is located between the first electrode 4 and the second electrode 6. Again the potential difference generated across the electrically resistive filter medium 2 causes the charged dust particles to be attracted to respective positive and negative ends of the electrically resistive filter medium 2, thus trapping them within the electrically resistive filter medium 2.

Figure 5:
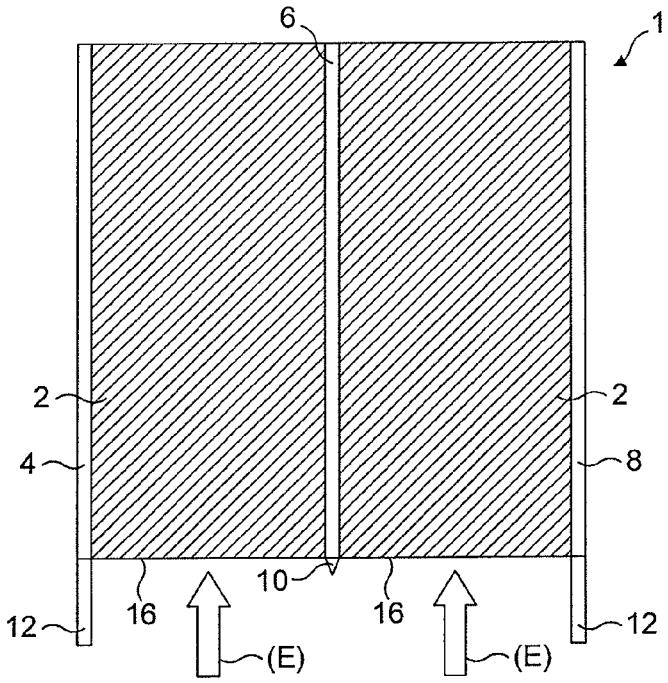
FIG. 5 is a schematic diagram of a section though an electrostatic filter according to the present invention.

A further embodiment of the present invention is shown in FIG. 5. It can be seen that the electrostatic filter 1 further comprises a third electrode 8. In this embodiment a further electrically resistive filter medium 2 is located between the second electrode 6 and the third electrode 8. The second and third electrodes 6, 8 are preferably each at a different voltage during use such that a potential difference is formed across the further electrically resistive filter medium 2. A second electrode of low curvature 12 extends from the third electrode 8 and projects below a lower surface 16 of the second electrically resistive filter medium 2.

It is preferable that this second electrode of low curvature 12 projects both upstream and downstream of the corona discharge electrode 10. Again this maximizes the volume over which the ionizing field is generated.

In this embodiment the first, second and third electrodes 4, 6, 8 together with the corona discharge electrode 10 and the electrodes of low curvature 12 form at least part of an air pathway which is partially filled by the electrically resistive filter medium 2 such that in use dust laden air (E) must pass the corona discharge means causing dust particles in the dust laden air (E) to become charged. The dust laden air (E) containing charged dust particles must then pass through either of the electrically resistive filter media 2. The potential difference generated across the electrically resistive filter medium 2 causes the charged dust particles to be attracted to respective positive and negative ends of the electrically resistive filter medium 2, thus trapping them within the electrically resistive filter medium.

In the embodiments described above the air pathways may be defined at least in part by the first electrode 4, the second electrode 6 and possibly also the third electrode 8. However, the electrostatic filter 1 may further comprise one or more walls, which together with the electrodes 4, 6, 8 form the air pathways such that dust laden air (A), (B), (C), (D) or (E) passes through the electrically resistive filter medium 2. The electrodes 4, 6, 8 may be of any suitable shape, for example they may be planar. The planar layers may be of any suitable shape for example square, rectangular, circular or triangular.

In an alternative embodiment the first electrode 4, the second electrode 6 and possibly also a third electrode 8 may be tubular. In such an embodiment the first and second electrodes 4, 6 and possibly also the third electrode 8 will define the air pathway through the electrically resistive filter medium 2. In such an embodiment additional walls are not required to form the air pathway. It is possible however that the electrically resistive filter medium 2 may be longer than the electrodes 4, 6, (8) and therefore some other wall or structure may surround a bottom or top side area of the electrically resistive filter medium 2.

An embodiment comprising first, second and third tubular electrodes 4, 6, 8 is shown in FIGS. 6, 7, 8*a* and 8*b*. In these embodiments the electrodes 4, 6, 8 are tubular with the second electrode 6 arranged concentrically between the first and third electrodes 4, 8. It can be seen that the electrodes 4, 6, 8 are cylindrical although they could be of any suitable shape such as square, rectangular, triangular or irregular in cross section.

Figure 6:
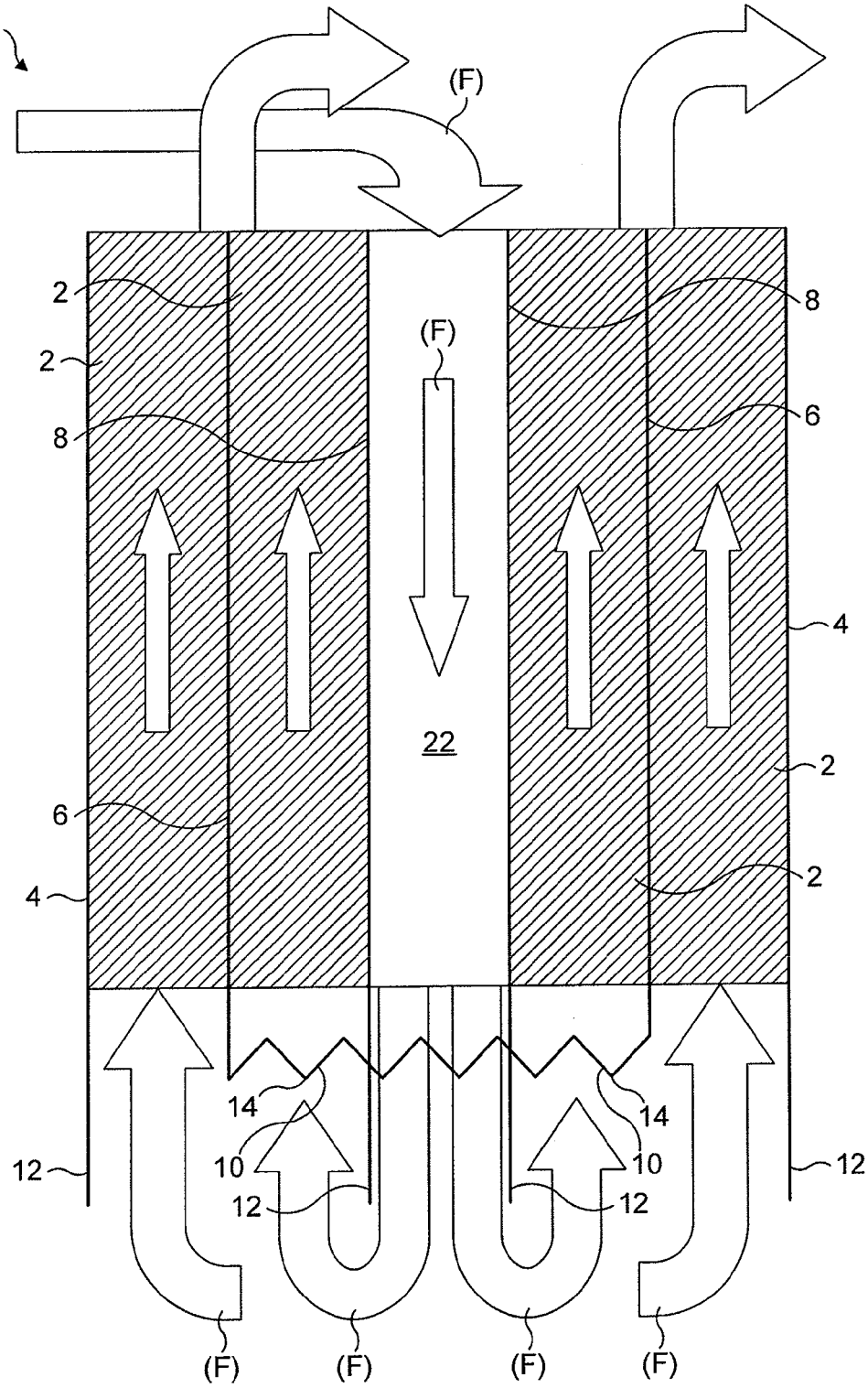
FIG. 6 is a schematic diagram of a section though an electrostatic filter according to the present invention.

In FIG. 6 it can be seen that the electrically resistive filter medium 2 is located between both the first and second electrodes 4, 6 and the second and third electrodes 6, 8. It can also be seen that in this embodiment the electrostatic filter 1 comprises two electrodes of low curvature 12 which are also cylindrical since the first is an extension of the first electrode 2 below the lower surface 16 of the electrically resistive filter medium 2 and the second is an extension of the third electrode 8 below the lower surface 16 of the electrically resistive filter medium 2.

The corona discharge electrode 10 is in the form of a serrated lower edge 14 of the second electrode 6 which extends below a lower surface 16 of the electrically resistive filter medium 2 and as such is also cylindrical in shape. The electrodes of low curvature 12 can be seen to project both upstream and downstream of the serrated lower edge 14.

In this embodiment an air passage 22 is formed through the centre of the electrostatic filter 1. This air passage 22 may be used to deliver dust laden air (F) to the corona discharge means. Dust laden air (F) travels through this air passage 22 toward the corona discharge means. The Dust laden air (F) then passes the corona discharge means and the dust particles become charged. The dust laden air (F) containing the charged dust particles then passes through the electrically resistive filter medium 2 located between the first and second electrodes 4, 6 or the electrically resistive filter medium 2 located between the second and third electrodes 6, 8 and the dust particles become trapped in the electrically resistive filter medium 2.

Figure 7:
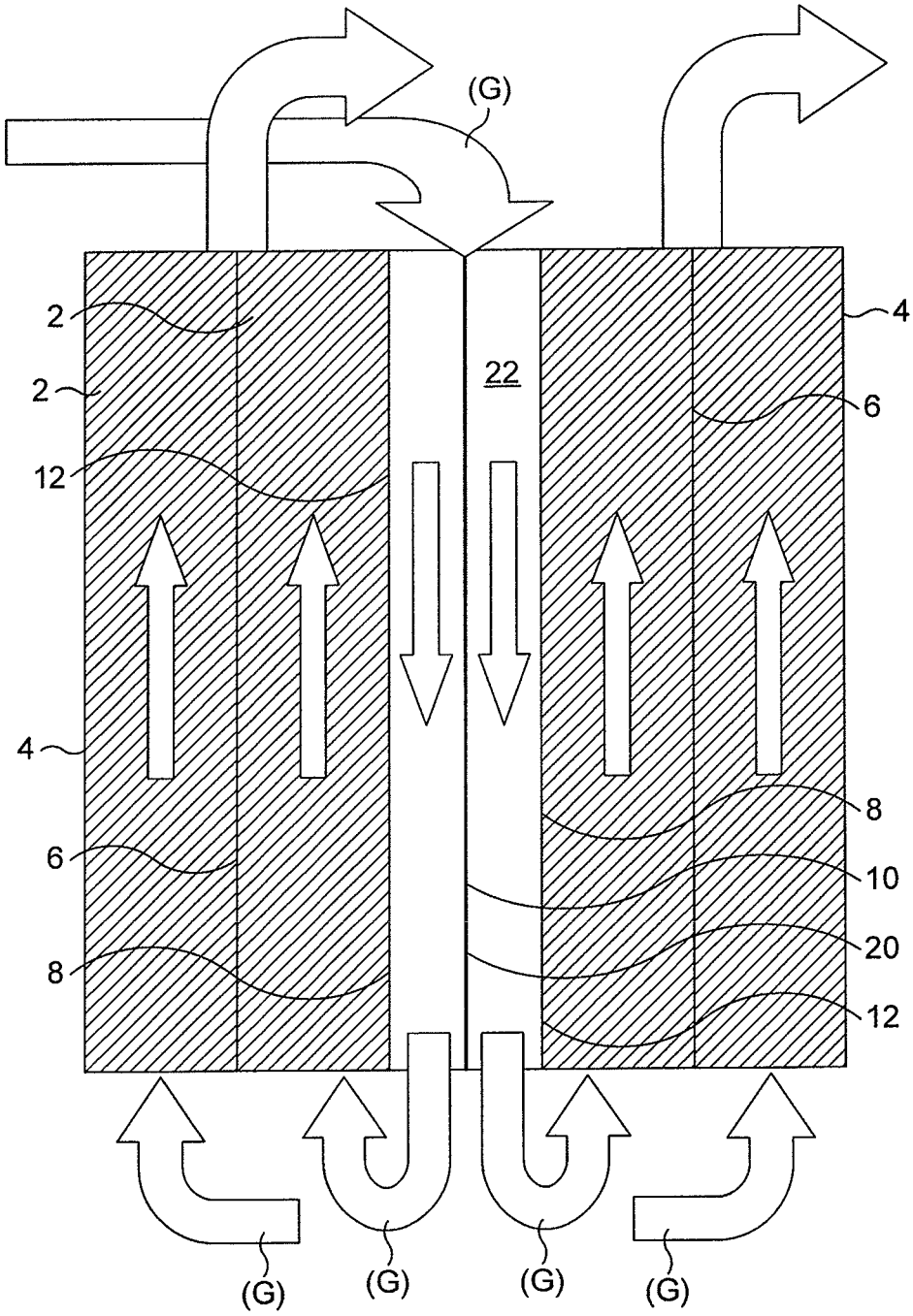
FIG. 7 is a schematic diagram of a section though an electrostatic filter according to the present invention.

In an alternative embodiment, such as the embodiment shown in FIG. 7 the corona discharge electrode 10 is remote from the second electrode 6. In this embodiment the corona discharge electrode 10 is in the form of a wire 20 and the electrode of low curvature 12 is the third electrode 8 which forms the wall of the passage 22. Dust laden air (G) travels through this air passage 22 and the dust particles are charged by the corona discharge means. The dust laden air (G) containing the charged dust particles then passes through the electrically resistive filter medium 2 located between the first and second electrodes 4, 6 or the electrically resistive filter medium 2 located between the second and third electrodes 6, 8 and the dust particles become trapped in the electrically resistive filter medium 2.

In the embodiments described in relation to FIGS. 5 to 7 the first and the third electrodes are at 0 Volts and the second electrode is at −4 to 10 kV. This also means that the corona discharge electrode 10 is at −4 to 10 kV and the electrode of low curvature is at 0 Volts.

The electrodes 4, 6, 8 may be formed from any suitable conductive material. Preferably, the first, second and/or third electrodes 4, 6, 8 are formed from a conductive metal sheet of from 0.1 mm, or 0.25 mm, or 0.5 mm, or 1 mm, or 1.5 mm, or 2 mm to 2.5 mm, or 3 mm, or in thickness.

In the embodiments described above the electrically resistive filter medium 2 may be formed from any suitable material for example an open cell reticulated polyurethane foam derived from a polyester.

In a preferred embodiment the electrically resistive filter medium 2 is 3 to 12 PPI and preferably 8 to 10 PPI and most preferably 3 to 6 PPI. The average pore size, PPI or type of electrically resistive filter medium 2 may however vary along its length. For example the pore size of the electrically resistive filter medium 2 shown in FIG. 8*a* varies along its length because it is formed from two sections each having a different pore size. In the embodiment shown the upstream portion has 3 or 8 PPI and the downstream portion has 6 or 10 PPI.

The pore size/diameter may be measured using the following method.

Figure 13A:
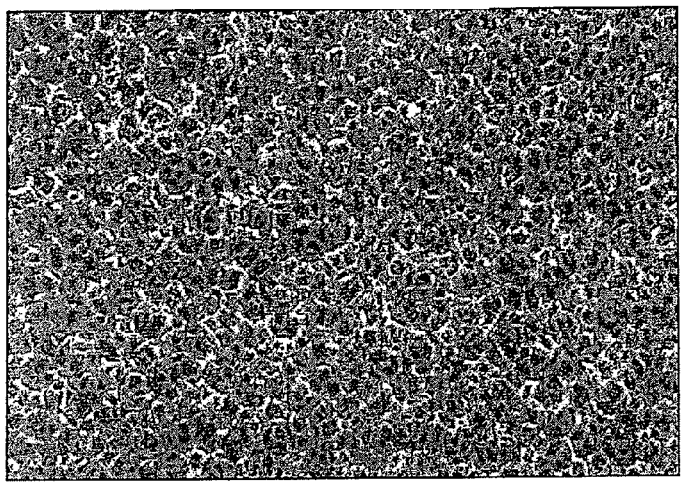
FIG. 13*a* shows a microscopic picture of the filter medium structure taken through a horizontal section.
Figure 13B:
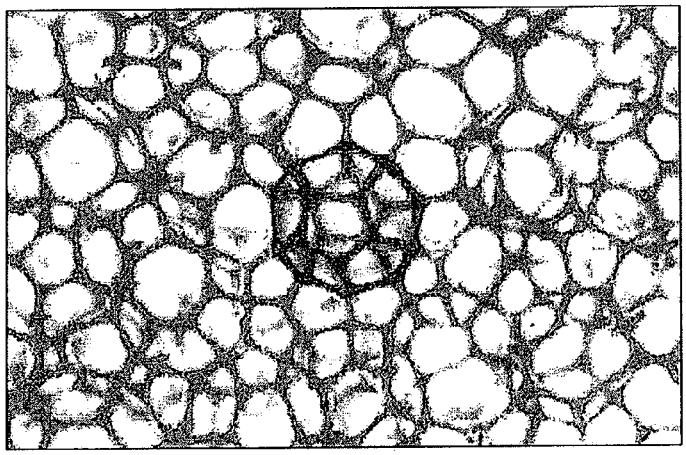
FIG. 13*b* shows the selection of individual pores for measuring pore diameter.
Figure 13C:
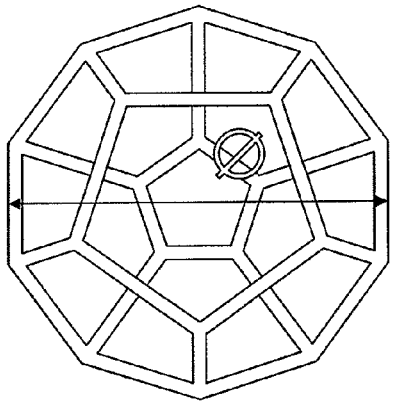
FIG. 13*c* shows how to measure the diameter of each pore.

1) Microscopic pictures of the foam structure should be taken through horizontal sections insuring pore consistency as shown in FIG. 13*a*
2) Five individual pores should be selected as shown in FIG. 13*b*
3) The diameter of each pore is measured as shown in FIG. 13*c* to an accuracy of no less than 100 micron and an average should be taken over the 5 pores.
4) This average pore size (pore diameter) is given in microns or mm.

The pores per inch is calculated by dividing 25400 (1 inch=25400 microns) by the pore diameter in microns.

FIGS. 8*a*, 8*b*, 9, 10*a* and 10*b* show the second aspect of the present invention where the electrostatic filter 1 has been incorporated into the cyclonic separating apparatus of a vacuum cleaner. Vacuum cleaners incorporating the cyclonic separating apparatus shown in FIGS. 8*a*, 8*b*, 9, 10*a* and 10*b* are shown in FIGS. 11 and 12.

Figure 11:
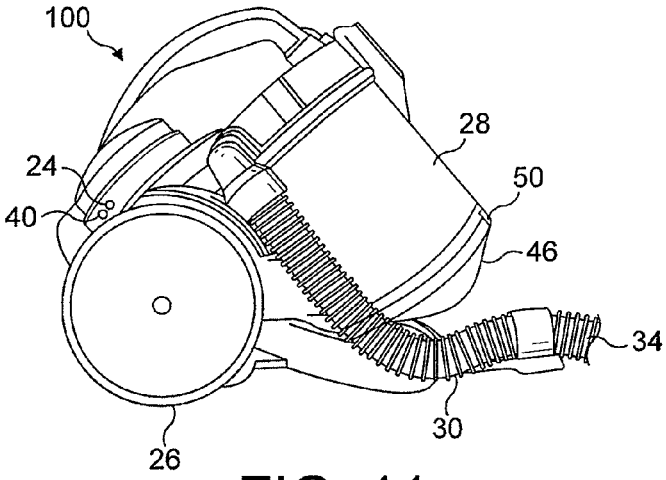
FIG. 11 is a canister vacuum cleaner incorporating the cyclonic separating apparatus shown in FIG. 8, 9 or 10.

In FIG. 11 the vacuum cleaner 100 comprises a main body 24, wheels 26 mounted on the main body 24 for maneuvering the vacuum cleaner 100 across a surface to be cleaned, and a cyclonic separating apparatus 28 also removably mounted on the main body 24. A hose 30 communicates with the cyclonic separating apparatus 28 and a motor and fan unit (not shown) is housed within the main body 24 for drawing dust laden air into the cyclonic separating apparatus 28 via the hose 30. Commonly, a floor-engaging cleaner head (not shown) is coupled to the distal end of the hose 30 via a wand to facilitate manipulation of the dirty air inlet 34 over the surface to be cleaned.

In use, dust laden air drawn into the cyclonic separating apparatus 28 via the hose 30 has the dust particles separated from it in the cyclonic separating apparatus 28. The dirt and dust is collected within the cyclonic separating apparatus 28 while the cleaned air is channelled past the motor for cooling purposes before being ejected from the vacuum cleaner 100 via an exit port in the main body 24.

Figure 12:
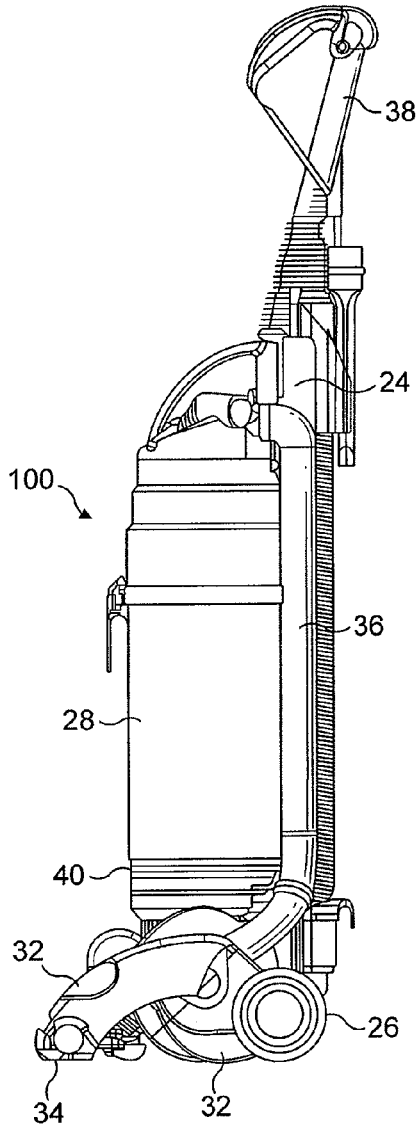
FIG. 12 is an upright vacuum cleaner incorporating the cyclonic separating apparatus shown in FIG. 8, 9 or 10.

The upright vacuum cleaner 100 shown in FIG. 12 also has a main body 24 in which a motor and fan unit (not shown) is mounted and on which wheels 26 are mounted to allow the vacuum cleaner 100 to be maneuvered across a surface to be cleaned. A cleaner head 32 is pivotably mounted on the lower end of the main body 24 and a dirty air inlet 34 is provided in the underside of the cleaner head 32 facing the surface to be cleaned. Cyclonic separating apparatus 28 is removably provided on the main body 24 and ducting 36 provides communication between the dirty air inlet 34 and the cyclonic separating apparatus 28. A wand and handle assembly 38 is releasably mounted on the main body 24 behind the cyclonic separating apparatus 28.

In use, the motor and fan unit draws dust laden air into the vacuum cleaner 100 via either the dirty air inlet 34 or the wand 38. The dust laden air is carried to the cyclonic separating apparatus 28 via the ducting 36 and the entrained dust particles are separated from the air and retained in the cyclonic separating apparatus 28. The cleaned air is passed across the motor for cooling purposes and then ejected from the vacuum cleaner 100.

The cyclonic separating apparatus 28 forming part of each of the vacuum cleaners 100 is shown in more detail in FIGS. 8*a*, 8*b*, 9, 10*a* and 10*b*. The specific overall shape of the cyclonic separating apparatus 28 can be varied according to the type of vacuum cleaner 100 in which the cyclonic separating apparatus 28 is to be used. For example, the overall length of the apparatus can be increased or decreased with respect to the diameter of the cyclonic separating apparatus 28.

The cyclonic separating apparatus 28 comprises an outer bin 42 which has an outer wall 44 which is substantially cylindrical in shape. The lower end of the outer bin 42 is closed by a base 46 which is pivotably attached to the outer wall 44 by means of a pivot 48 and held in a closed position by a catch 50. In the closed position, the base 46 is sealed against the lower end of the outer wall 44. Releasing the catch 50 allows the base 46 to pivot away from the outer wall 44 for emptying the cyclonic separating apparatus 28. A second cylindrical wall 52 is located radially inwardly of the outer wall 44 and spaced from it so as to form an annular chamber 54 between them. The second cylindrical wall 52 meets the base 46 (when the base 46 is in the closed position) and is sealed against it. The annular chamber 54 is delimited generally by the outer wall 44, the second cylindrical wall 52 and the base 46 to form the outer bin 42. This outer bin 42 is both a first stage cyclone 56 and a dust collector.

A dust laden air inlet 58 is provided in the outer wall 44 of the outer bin 42. The dust laden air inlet 58 is arranged tangentially to the outer wall 44 so as to ensure that incoming dust laden air is forced to follow a helical path around the annular chamber 54. A fluid outlet is provided in the outer bin 42 in the form of a shroud 60. The shroud 60 comprises a cylindrical wall 62 in which a large number of perforations 64 are formed. The only fluid outlet from the first stage cyclone 56 is formed by the perforations 64 in the shroud 60. A passageway 66 is formed downstream of the shroud 60. The passageway 66 communicates with a plurality of second stage cyclones 68 which are arranged in parallel. The passageway 66 may be in the form of an annular chamber which leads to inlets 69 of the second stage cyclones or may be in the form of a plurality of distinct air passageways each of which leads to a distinct second stage cyclone 68.

A third cylindrical wall 70 extends between the base 46 and a vortex finder plate 72 which forms the top surface of each of the second stage cyclones 68. The third cylindrical wall 70 is located radially inwardly of the second cylindrical wall 52 and is spaced from it so as to form a second annular chamber 74 between them.

Figure 9:
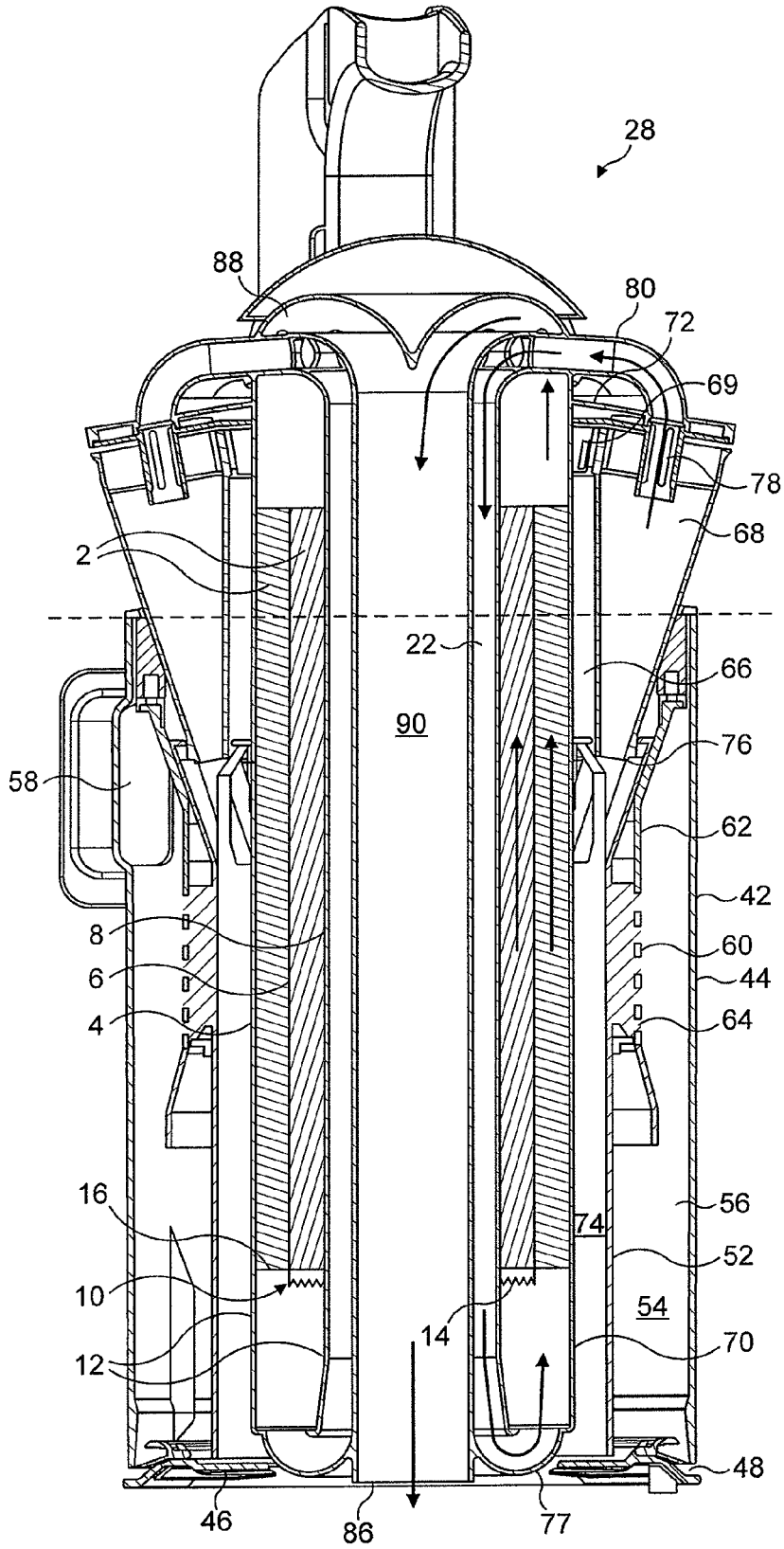
FIG. 9 is a section through a cyclonic separating apparatus which incorporates an electrostatic vacuum cleaner according to the present invention.
Figure 10A:
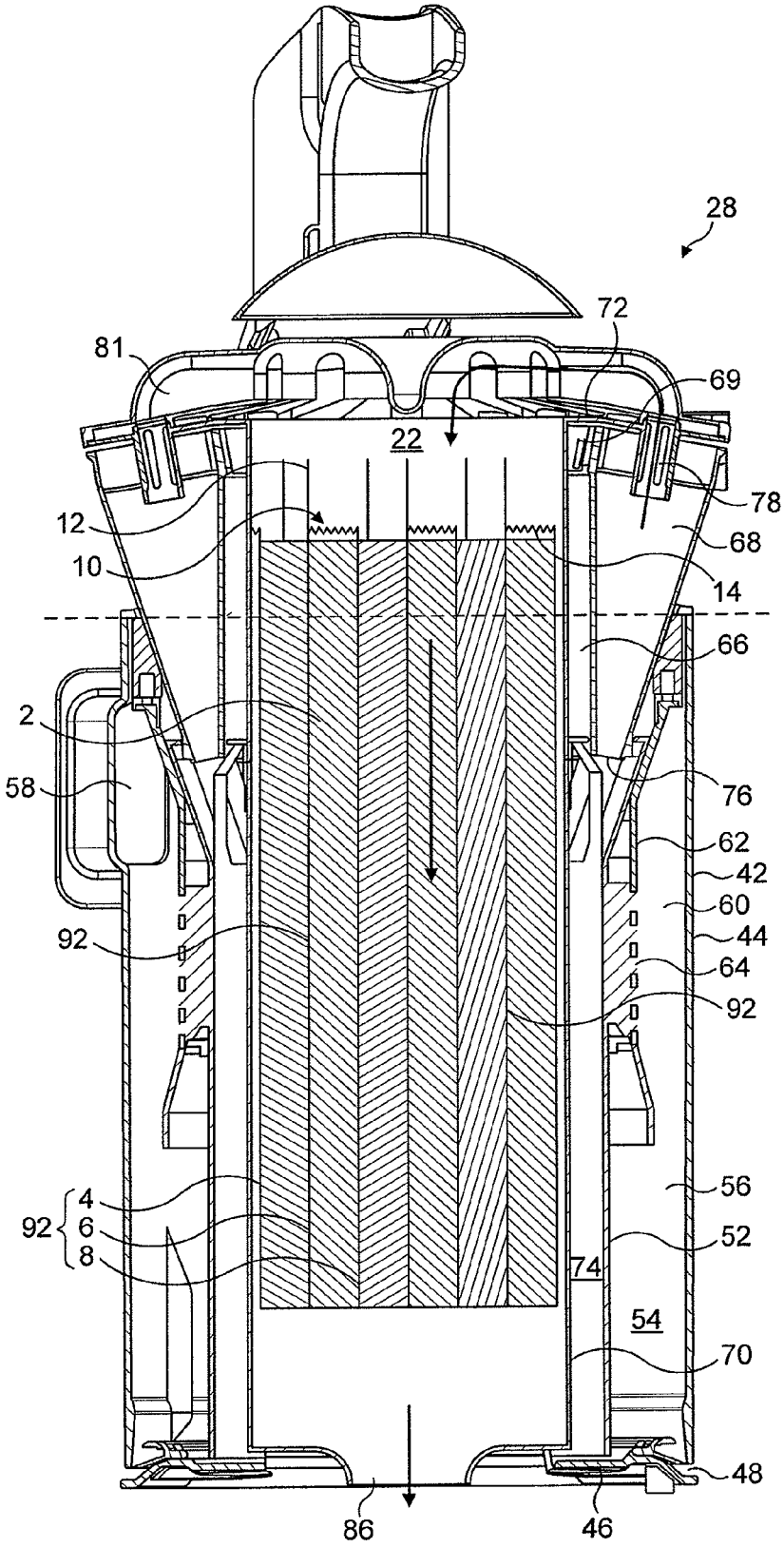
FIG. 10*a* is a longitudinal section through a cyclonic separating apparatus which incorporates an electrostatic vacuum cleaner according to the present invention.

When the base 46 is in the closed position, the third cylindrical wall 70 may be sealed against it as shown in FIG. 10*a*. Alternatively as shown in FIGS. 8*a* and 9 the third cylindrical wall 70 may be sealed by an electrostatic filter base plate 77.

The second stage cyclones 68 are arranged in a circle above the first stage cyclone 56. They are arranged in a ring which is centred on the axis of the first stage cyclone 56. Each second stage cyclone 68 has an axis which is inclined downwardly and towards the axis of the first stage cyclone 58.

Each second stage cyclone 68 is frustoconical in shape and comprises a cone opening 76 which opens into the top of the second annular chamber 74. In use dust separated by the second stage cyclones 68 will exit through the cone openings 76 and will be collected in the second annular chamber 74. A vortex finder 78 is provided at the upper end of each second stage cyclone 68. The vortex finders 78 may be an integral part of the vortex finder plate 72 or they may pass through the vortex finder plate 72.

Figure 8A:
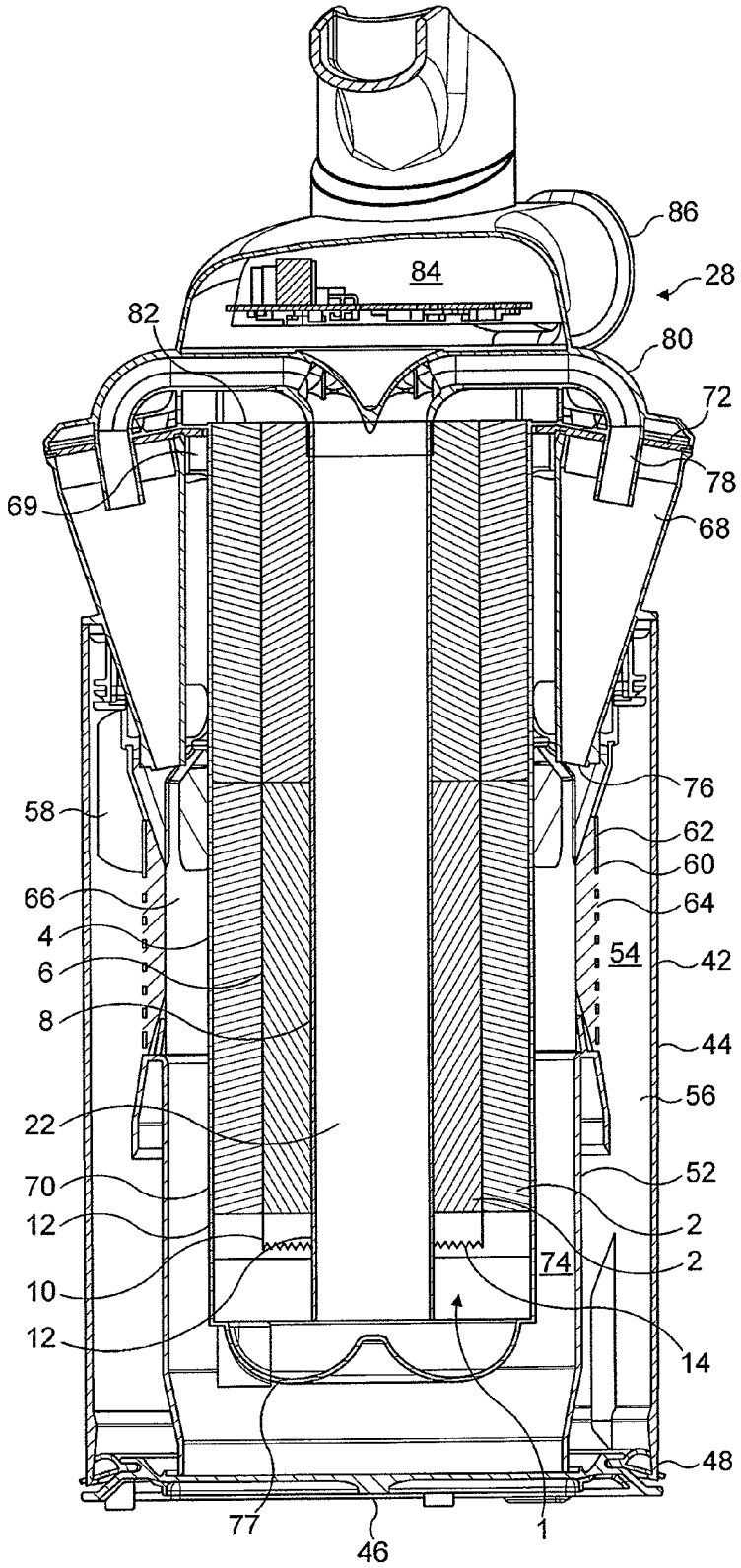
FIG. 8*a* is a longitudinal section through a cyclonic separating apparatus which incorporates an electrostatic vacuum cleaner according to the present invention.

In the embodiment shown in FIGS. 8*a* and 9 the vortex finders 78 lead into vortex finder fingers 80 which communicate directly with the electrostatic filter 1 rather than emptying into a plenum chamber which communicates with the electrostatic filter 1. It is however possible that the vortex finders 78 could communicate with a plenum 81 which in turn communicates with the electrostatic filter 1. Such a plenum is shown in FIG. 10*a*.

The electrostatic filter 1 is arranged concentrically down the centre of the cyclonic separating apparatus 28 such that at least a part of the first stage cyclone 56 and the second stage cyclones 68 surround the electrostatic filter 1.

In FIGS. 8*a* and 9 it can be seen that an air passage 22 leads from the vortex finder fingers 80 to the corona discharge means. This air passage 22 is used to deliver dust laden air to the corona discharge means. The electrostatic filter 1 comprises concentrically arranged cylindrical first, second and third electrodes 4, 6, 8. An electrically resistive filter medium 2 is located between both the first and second electrodes 4, 6 and the second and third electrodes 6, 8. The electrostatic filter 1 also comprises a corona discharge means in the form of a corona discharge electrode 10 and two electrodes of low curvature 12.

The first electrode of low curvature 12 is an extension of the first electrode 2 below the lower surface 16 of the electrically resistive filter medium 2 and the second electrode of low curvature 12 is an extension of the third electrode 8 below the lower surface 16 of the electrically resistive filter medium 2.

The corona discharge electrode 10 is in the form of a serrated lower edge 14 of the second electrode 4 which extends below a lower surface 16 of the electrically resistive filter medium 2. The electrodes of low curvature 12 can be seen to project both upstream and downstream of the serrated lower edge 14 of the corona discharge electrode 10.

Other features of the electrostatic filter may be as described above in relation to FIG. 6.

Figure 8B:
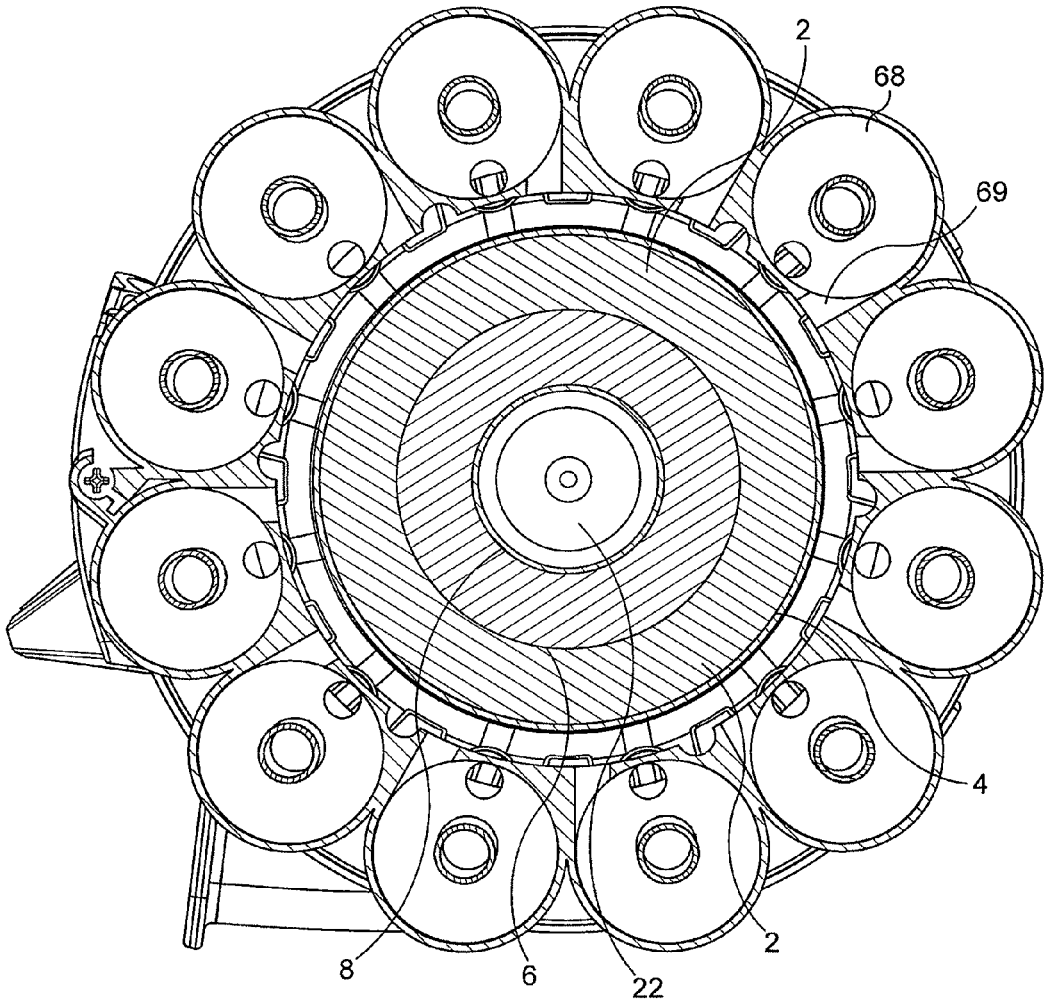
FIG. 8*b* is a horizontal section through the cyclonic separating apparatus shown in FIG. 8*a;*

During use of the separating apparatus shown in FIGS. 8*a*, 8*b* and 9, dust laden air enters the cyclonic separating apparatus 28 via the dirty air inlet 34 and, because of the tangential arrangement of the inlet 34, the dust laden air follows a helical path around the outer wall 44. Larger dirt and dust particles are deposited by cyclonic action in the annular chamber 54 and collected therein. The partially-cleaned dust laden air exits the annular chamber 54 via the perforations 64 in the shroud 60 and enters the passageway 66. The partially-cleaned dust laden air then passes into tangential inlets 69 of the second stage cyclones 68. Cyclonic separation is set up inside the second stage cyclones 68 so that separation of some of the dust particles which are still entrained within the airflow occurs. The dust particles which are separated from the airflow in the second stage cyclones 68 are deposited in the second annular chamber 74 while the further cleaned dust laden air exits the second stage cyclones 68 via the vortex finders 78. The further cleaned dust laden air then passes through the vortex fingers 80 into the air passage 22 and into the electrostatic filter 1.

The further cleaned dust laden air then travels down the air passage 22 and past the corona discharge means formed from the corona discharge electrode 10 and the electrode of low curvature 12 such that any dust particles remaining in the further cleaned dust laden air become charged. The further cleaned dust laden air containing the charged dust then travels through the electrically resistive filter medium 2. The potential difference generated across the electrically resistive filter medium 2 causes the charged dust particles to be attracted to respective positive and negative ends of the electrically resistive filter medium 2, thus trapping them within the electrically resistive filter medium 2.

In FIG. 8*a* the cleaned air then leaves the electrostatic filter 1 via apertures 82 in the vortex finder plate 72 and enters an exhaust manifold and exhausts the cyclonic separating apparatus 28 via the exit port 86.

In FIG. 9 the cleaned air then leaves the electrostatic filter 1 by passing through exit fingers 88 arranged at the top end of the electrostatic filter 1 downstream of the electrically resistive filter medium 2. The exit fingers 88 direct the air towards an exhaust passage 90 which passes through the centre of the cyclonic separating apparatus 28. Air passes through this exhaust passage 90 and exhausts the cyclonic separating apparatus 28 via the exit port 86 at the base of the cyclonic separating apparatus 28.

Figure 10B:
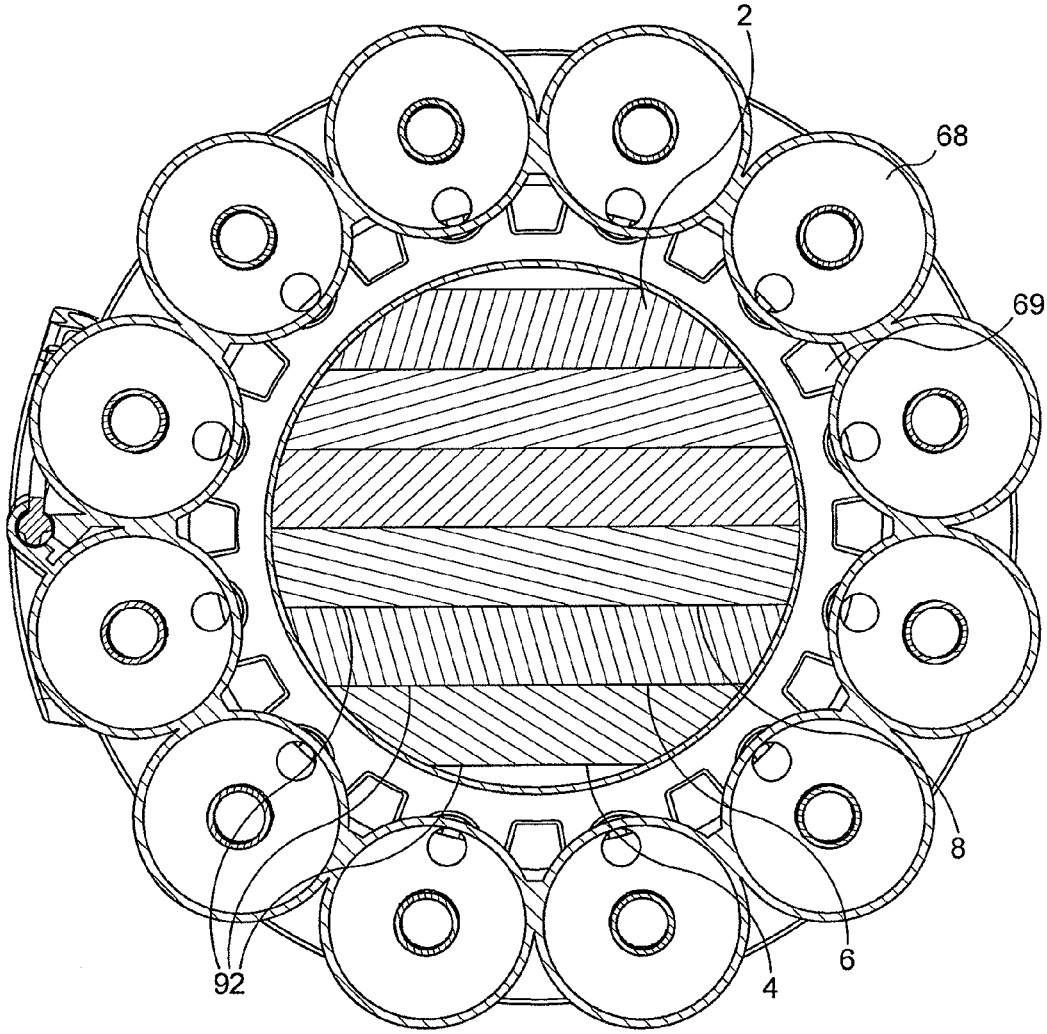
FIG. 10*b* is a horizontal section through the cyclonic separating apparatus shown in FIG. 10*a;*

In FIGS. 10*a* and 10*b* it can be seen that the electrostatic filter 1 comprises a plurality of flat plate electrodes 92 which are located in the air passage 22 which is fluidly connected to plenum 81. An electrically resistive filter medium 2 is located between adjacent electrodes 92 The corona discharge means comprises a plurality of corona discharge electrodes 10 and a plurality of electrodes of low curvature 12.

The corona discharge electrodes 10 are in the form of serrated upper edges 14 of electrodes which are arranged between two other electrodes. The electrodes of low curvature 12 are formed from upper portions of electrodes which are located on either side of the corona discharge electrodes 10. It can be seen that the electrodes of low curvature 12 project both upstream and downstream of the serrated upper edges 14 of the corona discharge electrodes 10.

During use of the separating apparatus shown in FIGS. 10*a* and 10*b*, dust laden air travels through the cyclonic separating apparatus 28 in the same way as described above in relation to FIGS. 8*a* and 9 until it exits the vortex finders 78. In FIG. 10*a* once the air has left the vortex finders 78 the air travels through the plenum 81 which collects air from the vortex finders 78 and channels it into the air passage 22 and into the electrostatic filter 1.

The air then travels past the corona discharge means formed from the corona discharge electrodes 10 and the electrodes of low curvature 12 such that any dust particles remaining in the air become charged. The air containing the charged dust then travels through the electrically resistive filter medium 2. The potential difference generated across the electrically resistive filter medium 2 causes the charged dust particles to be attracted to respective positive and negative ends of the electrically resistive filter medium 2, thus trapping them within the electrically resistive filter medium 2.

The cleaned then leaves the electrostatic filter 1 and exhausts the cyclonic separating apparatus 28 via the exit port 86 at the base of the cyclonic separating apparatus 28.

Dust particles which have been separated from the dust laden air by the first and second stage cyclones 56, 68 will be collected in both of the annular chambers 54, 74. In order to empty these chambers, the catch 50 is released to allow the base 46 to pivot for example about a hinge (not shown) so that the base 46 falls away from the lower ends of the walls 44, 52. Dirt and dust collected in the chambers 54, 74 can then easily be emptied from the cyclonic separating apparatus 28.

It will be appreciated from the foregoing description that the cyclonic separating apparatus 28 includes two distinct stages of cyclonic separation and a distinct stage of electrostatic filtration. In the preferred embodiments shown the electrostatic filter is located downstream of all of the cyclonic cleaning stages. The first stage cyclone 56 constitutes a first cyclonic separating unit consisting of a single first cyclone which is generally cylindrical in shape. In this first stage cyclone the relatively large diameter of the outer wall 44 means that comparatively large particles of dirt and debris will be separated from the air because the centrifugal forces applied to the dirt and debris are relatively small. Some fine dust will be separated as well. A large proportion of the larger debris will reliably be deposited in the annular chamber 54.

There are 12 second stage cyclones 68. In these second stage cyclones 68 each second stage cyclone 68 has a smaller diameter than the first stage cyclone 56 and so is capable of separating finer dirt and dust particles than the first stage cyclone 56. It also has the added advantage of being challenged with air which has already been cleaned by the first stage cyclone 56 and so the quantity and average size of entrained dust particles is smaller than would otherwise have been the case. The separation efficiency of the second stage cyclones 68 is considerably higher than that of the first stage cyclone 56, however some small particles will pass through the second stage cyclones 68 and reach the electrostatic filter. The electrostatic filter 1 is capable of removing dust particles which remain in the air after it has passed through the first stage cyclone 56 and the second stage cyclones 68.

Although a corona discharge means is shown in FIGS. 8*a*, 8*b* 9, 10*a* and 10*b* the electrostatic filter will function without it and therefore the corona discharge means is not essential. The corona discharge means is however desirable as it may help to increase the separation efficiency of the electrostatic filter.

In the embodiments shown it is preferable that all of the electrodes are non-porous. However, as long as the first and second electrodes are non-porous it is possible that any other electrodes present could be porous if desired.

The invention claimed is:

1. An electrostatic filter comprising:

an electrically resistive filter medium located between a first and a second electrode, each at a different voltage during use, such that a potential difference is formed across the filter medium, wherein electrical resistivity of the filter medium varies along a length of the filter medium.

2. The electrostatic filter of claim 1, wherein the average pore diameter, the pores per inch and/or the type of filter medium varies along the length of the filter medium.

3. The electrostatic filter of claim 1, wherein the variation occurs in a single filter medium.

4. The electrostatic filter of claim 1, wherein a plurality of sections of filter medium are brought together to form the filter medium.

5. The electrostatic filter of claim 2, wherein the pores per inch increase in a downstream direction.

6. The electrostatic filter of claim 2, wherein the average pore size decreases in a downstream direction.

7. The electrostatic filter of claim 1, wherein the electrical resistivity decreases in a downstream direction.

8. The electrostatic filter of claim 1, wherein the filter medium comprises an open cell reticulated foam.

9. The electrostatic filter of claim 1, wherein the first and second electrodes are substantially non-porous.

10. The electrostatic filter of claim 9, wherein the first and second electrodes are non-porous along their entire length.

11. The electrostatic filter of claim 1, wherein the filter medium is in contact with the first and/or the second electrode.

12. The electrostatic filter of claim 1, further comprising at least one corona discharge means.

13. The electrostatic filter of claim 1, wherein the first and/or second electrode is formed from a conductive metal sheet or foil of from 0.1 mm to 4 mm in thickness.

14. A vacuum cleaner comprising the electrostatic filter of claim 1.

* * * * *